US008096550B2

(12) United States Patent
Shih et al.

(10) Patent No.: US 8,096,550 B2
(45) Date of Patent: Jan. 17, 2012

(54) PAPER-OUT MECHANISM FOR PRINTING APPARATUS

(75) Inventors: Chih-Kun Shih, Santa Clara, CA (US); Chen-Lu Fan, Taipei Hsien (TW); Chun-Hsien Lin, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 135 days.

(21) Appl. No.: 12/632,377

(22) Filed: Dec. 7, 2009

(65) Prior Publication Data

US 2011/0074097 A1 Mar. 31, 2011

(30) Foreign Application Priority Data

Sep. 29, 2009 (CN) ..... 2009 1 0307982

(51) Int. Cl.
*B65H 31/04* (2006.01)

(52) U.S. Cl. ..... 271/213; 271/221

(58) Field of Classification Search ..... 271/213, 271/221, 223, 207, 241, 248, 253, 254
See application file for complete search history.

(56) References Cited

U.S. PATENT DOCUMENTS 5,135,214 A * 8/1992 Sugimoto et al. ..... 271/241
6,206,365 B1 * 3/2001 Nanba et al. ..... 271/217

FOREIGN PATENT DOCUMENTS

JP 2001253631 A * 9/2001

* cited by examiner

*Primary Examiner* — Michael McCullough
(74) *Attorney, Agent, or Firm* — Atlis Law Group, Inc.

(57) ABSTRACT

A paper-out mechanism includes a paper out wall and a paper out board. The paper out wall defines a paper out opening. The paper out opening includes a first edge and a second edge facing to the first edge. The paper out board is slidably mounted on the paper out wall below the paper out opening. The paper out board includes an adapter portion which includes a first side and a second side. A distance between the first side and second side is greater than a distance between the first edge and the second edge. The paper out board is slidable between a first position and a second position. In the first position, the first side is in alignment with the first edge. In the second position, the second side is in alignment with the second edge.

15 Claims, 4 Drawing Sheets

PAPER-OUT MECHANISM FOR PRINTING APPARATUS

BACKGROUND

1. Technical Field

The present disclosure relates to paper transmitting mechanisms, and particularly to a paper-out mechanism for a printing apparatus.

2. Description of Related Art

Generally, a printing apparatus, such as a printer or a photocopying machine, feeds a sheet of paper, prints a desired image on the paper, and discharges the printed paper to a paper out board which is used to carry the printed paper thereon.

In most office environments, a single printing apparatus is used by a plurality of users. Papers printed by different users are often stacked together on the paper out board of the printing apparatus. It is time-consuming and inconvenient to separate different users' printed papers.

Therefore, there is room for improvement within the art.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
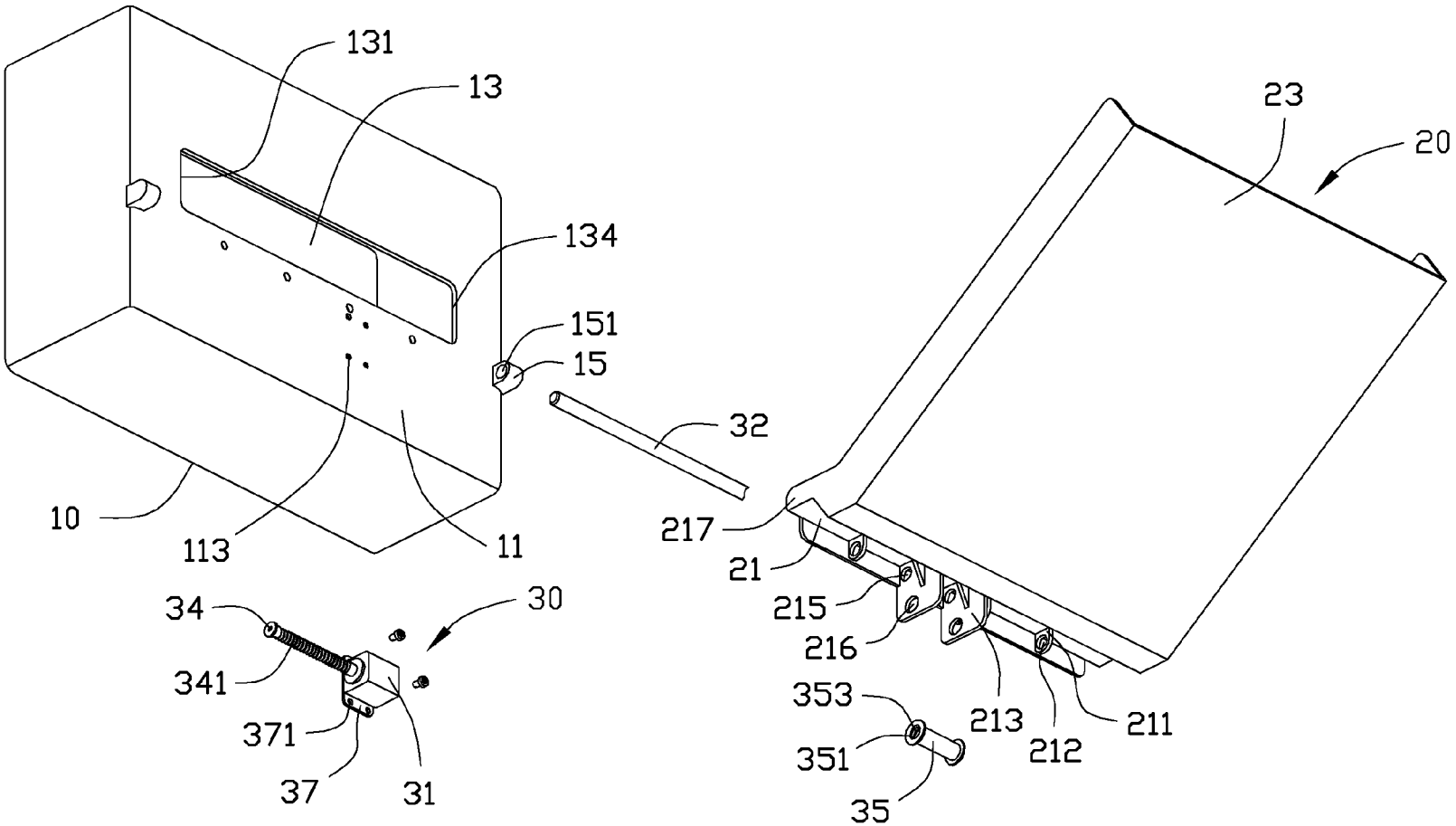
FIG. 1 is an exploded and isometric view of a paper-out mechanism for a printing apparatus.

Referring to FIG. 1, an embodiment of an paper-out mechanism for a printing apparatus 10 includes a paper out board 20 and a drive unit 30. The printing apparatus 10 comprises a paper out wall 11. The wall 11 defines a paper out opening 13 via which printed papers are discharged out of the printing apparatus 10. The opening 13 has a first edge 131 and a second edge 134 facing to the first edge 131. A pair of securing seats 15 is formed adjacent to opposite edges 131, 134 of the opening 13. Each securing seat 15 defines a securing hole 151. The wall 11 defines a plurality of fixing holes 113 below the opening 13.

The paper out board 20 includes a horizontal adapter portion 21 and a titled load portion 23 extending from the adapter portion 21. A pair of attaching pieces 211 extends from a bottom side of the adapter portion 21. Each attaching piece 211 defines a first through hole 212. A pair of restricting pieces 213 is formed between the pair of attaching pieces 211.

Each restricting piece 213 defines a second through hole 215 and a receiving hole 216. The two second through holes 215 and the two first through holes 212 of the pair of attaching pieces 211 are aligned on a same line.

The adapter portion 21 has a first side 217 and a second side 218 (referring to FIG. 4) facing to the first side 217. A distance between the first side 217 and second side 218 of the adapter portion 21 is greater than a distance between the first edge 131 and the second edge 134 of the opening 13. Thus, a width of the adapter portion 21 is greater than that of the opening 13.

The drive unit 30 includes a motor 31, a guiding pole 32, and a sleeve 35. The motor 31 includes a threaded rod 34 which is capable of being rotated by the motor 31. The threaded rod 34 has external screw threads 341 thereon. A flange 37 is formed on the motor 31. A plurality of mounting holes 371 is defined in the flange 37.

The guiding pole 32 is capable of extending through the first through holes 212 and the second through holes 215 of the paper out board 20 and being mounted in the securing holes 151 of the wall 11.

A length of the sleeve 35 is equal to a distance between the pair of restricting pieces 213. The sleeve 35 is adapted to be sandwiched between the pair of restricting pieces 213. A screw hole 351 is defined in the sleeve 35 in an axial direction of the sleeve 35. The screw hole 351 forms a plurality of internal screw threads 353 corresponding to the external screw threads 341.

Figure 2:
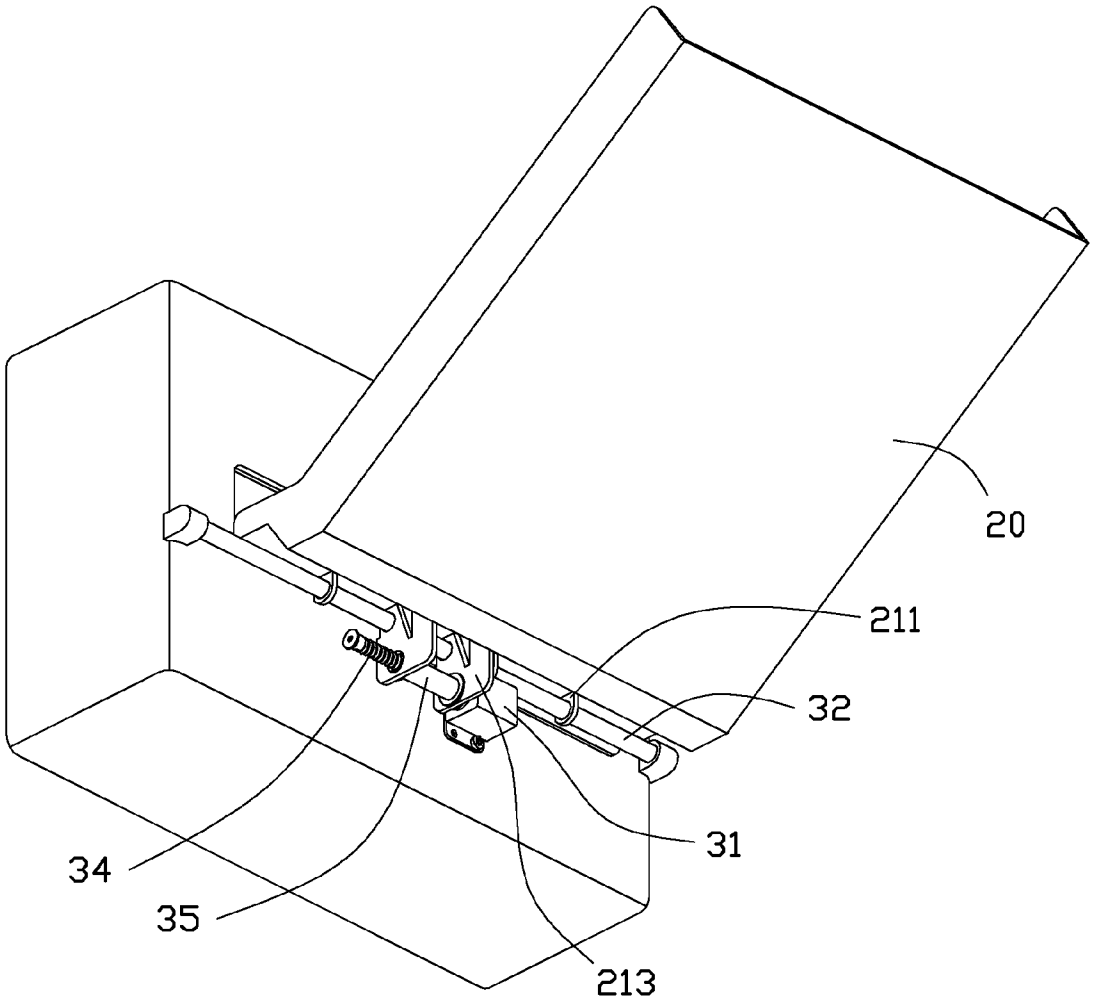
FIG. 2 is an assembly view of the paper-out mechanism of FIG. 1, which includes a paper out board located in a first position.

Referring to FIGS. 1 and 2, in assembly of the paper-out mechanism, the sleeve 35 is firstly sandwiched between the restricting pieces 213 of the paper out board 20. The screw hole 351 of the sleeve 35 is aligned with the receiving holes 216 of the restricting pieces 213. The threaded rod 34 of the motor 31 extends through a receiving hole 216, screws into the screw hole 351 with the external screw threads 341 cooperating with the internal screw threads 353, and extends through the other receiving hole 216.

The guiding pole 32 is inserted in the first through holes 212 and the second through holes 215. One end of the guiding pole 32 is secured in one securing hole 151 of one securing seat 15, and the other end of the guiding pole 32 is secured in the other securing hole 151 of the other securing seat 15. Therefore, the guiding pole 32 is mounted on the wall 11, and the paper out board 20 is slidable on the guiding pole 32. At last, the mounting holes 371 of the motor 31 are aligned with the fixing holes 113 of the wall 11. The motor 31 is then mounted on the wall 11 via a plurality of screws.

Figure 3:
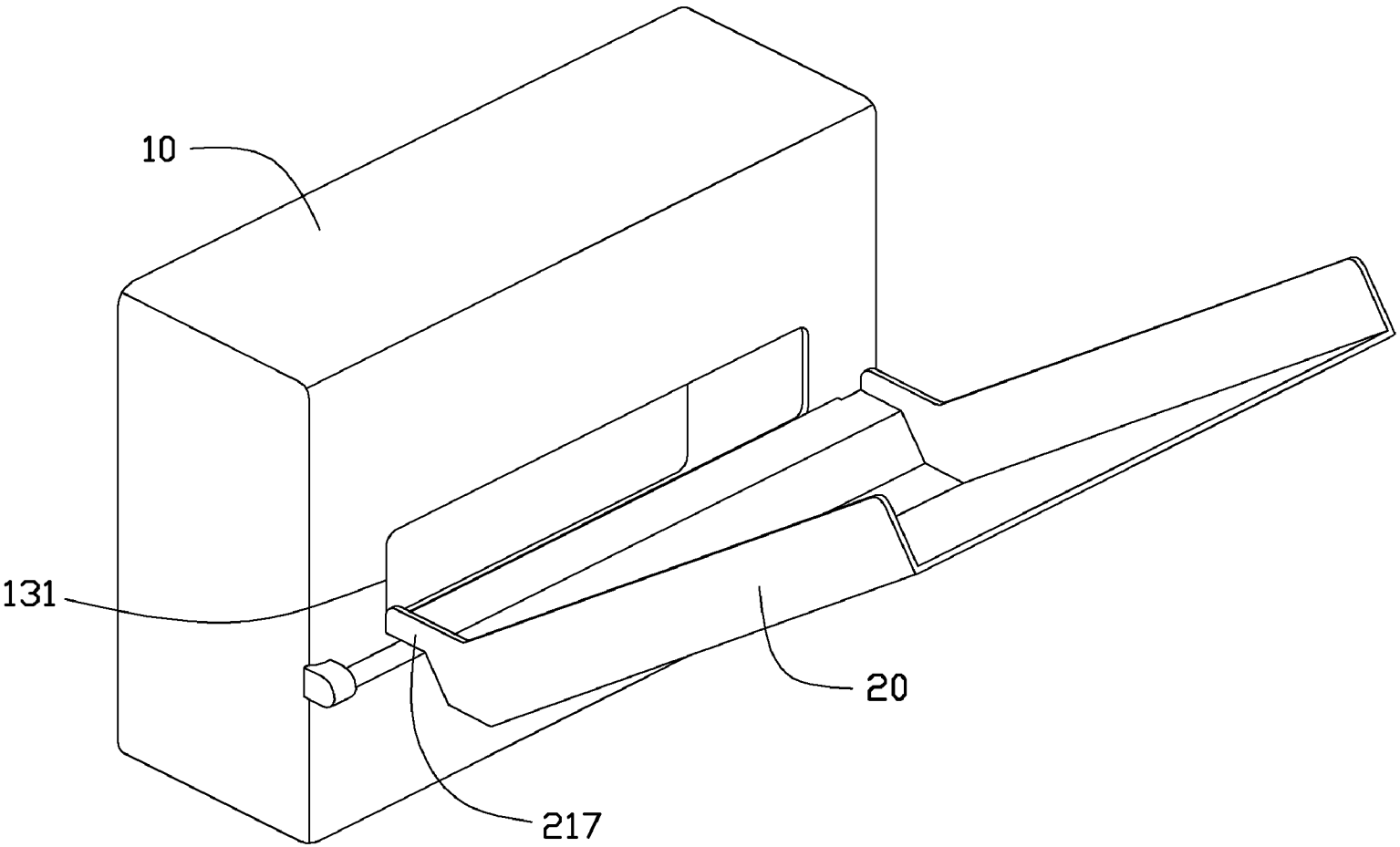
FIG. 3 is another view of the paper-out mechanism of FIG. 2, viewed in another aspect.
Figure 4:
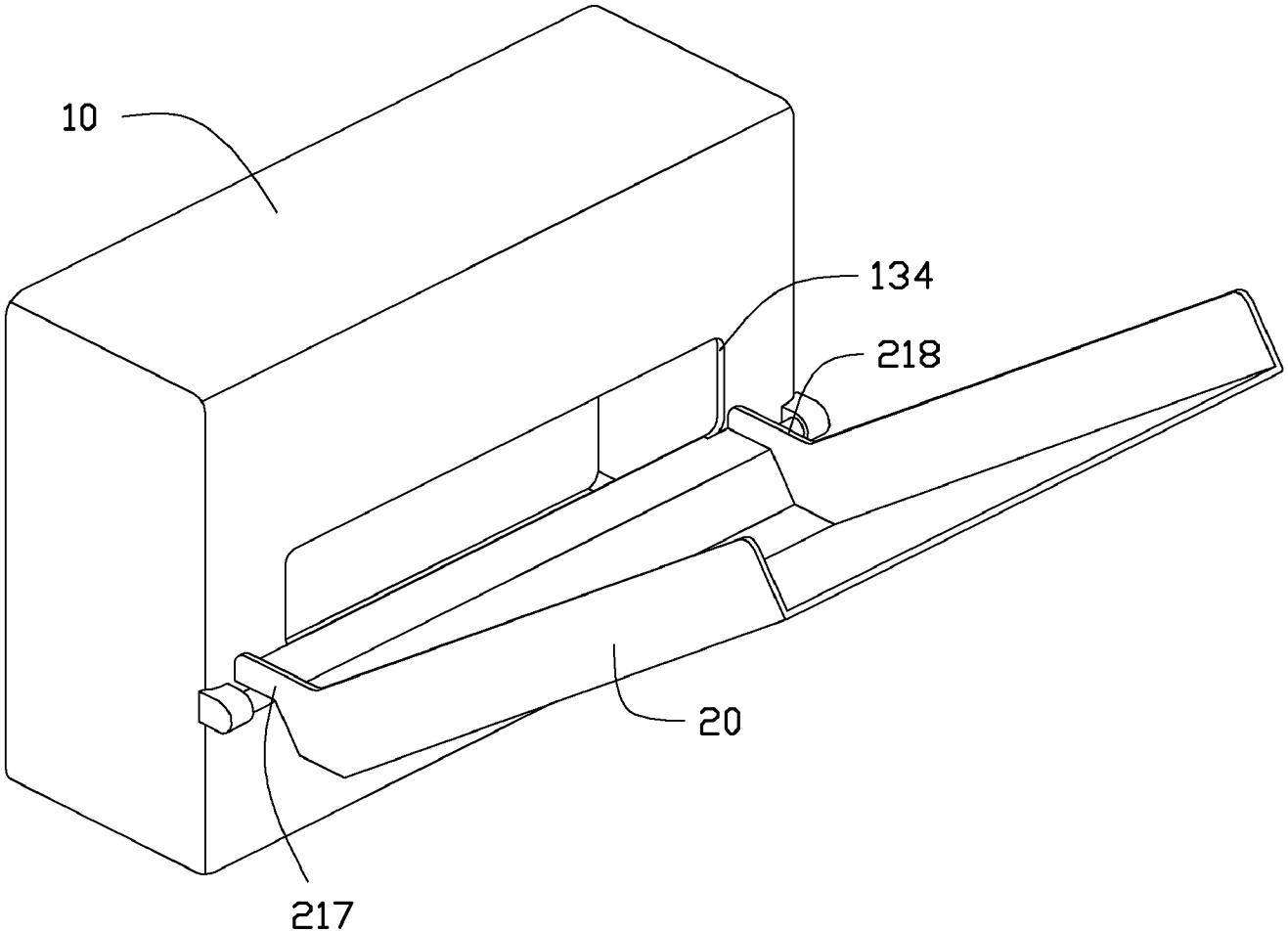
FIG. 4 is an isometric view of the paper-out mechanism of FIG. 2, in which the paper out board is located in a second position.

Referring to FIGS. 2 to 4, during the operation, the motor 31 rotates to drive the threaded rod 34 in the screw hole 351 of the sleeve 35. Because the motor 31 is secured on the wall 30, the threaded rod 34 pushes and pulls the sleeve 35 and the paper out board 20 sliding on the guiding pole 32.

When printing a first file, the motor 31 drives the paper out board 20 sliding on the guiding pole 32 to have the first side 217 of the paper out board 20 in alignment with the first edge 131 of the opening 13. Therefore, corresponding printed papers of the first file are located on the load portion 23 in this position. When printing a second file, the motor drives the paper out board 20 sliding on the guiding pole 32 to have the second side 218 of the paper out board 20 in alignment with the second edge 134 of the opening 13. Therefore, corresponding printed papers of the second file are located on the load portion 23 in another position. When printing a third file, the motor 31 drives the paper out board 20 sliding to have the first side 217 in alignment with the first edge 131 again. Corresponding printed papers of the third file are located on the load portion 23 in a position which is above the printed papers of the first files. The printed papers of the first and third files are separated by the printed papers of the second file. When printing a fourth file, the paper out board 20 slides to have the printed papers of the fourth file located above the printed papers of the second files. The printed papers of the second and fourth files are separated by the printed papers of the third files. Thus, printed papers of different files are positioned in staggered fashion on the load portion 23. It is then convenient to separate the papers of different printing jobs.

It is to be understood, however, that even though numerous characteristics and advantages of the embodiments have been set forth in the foregoing description, together with details of the structure and function of the embodiments, the disclosure is illustrative only, and changes may be made in detail, especially in matters of shape, size, and arrangement of parts within the principles of the present disclosure to the full extent indicated by the broad general meaning of the terms in which the appended claims are expressed.

What is claimed is:

1. A paper-out mechanism for a printing apparatus, comprising:

a paper out wall defining a paper out opening therein, the paper out opening comprising a first edge and a second edge; and a paper out board slidably mounted to the paper out wall below the paper out opening, the paper out board capable of receiving printed papers discharged from the paper out opening; the paper out board comprising an adapter portion, the adapter portion comprising a first side and a second side, a distance between the first side and second side of the adapter portion greater than a distance between the first edge and the second edge of the paper out opening;

wherein the paper out board is slidable between a first position and a second position; in the first position, the first side of the adapter portion is in substantial alignment with the first edge of the paper out opening; in the second position, the second side of the adapter portion is in substantial alignment with the second edge of the paper out opening;

a sleeve is mounted on the paper out board, the sleeve defines a screw hole, a threaded rod is rotatably mounted on the paper out wall, and the threaded rod is adapted to screw in the screw hole of the sleeve to drive the sleeve and the paper out board sliding; and two restricting pieces are located on the paper out board, the sleeve is sandwiched and secured between the two restricting pieces.

2. The paper-out mechanism of claim 1, wherein the paper out board comprises at least one restricting piece in which a through hole is defined; a pair of securing seats is located on the paper out wall, each securing seat defines a securing hole therein; a guiding pole extends through the through hole of the paper out board, and opposite ends of the guiding pole are mounted in the securing holes to slidably mount the paper out board on the paper out wall.

3. The paper-out mechanism of claim 1, wherein each of the two restricting pieces defines a receiving hole, the screw hole of the sleeve is in alignment with the receiving holes of the two restricting pieces, the threaded rod extends through the receiving holes.

4. The paper-out mechanism of claim 1, wherein the threaded rod is mounted on a motor, the motor is capable of rotating the threaded rod in the screw hole of the sleeve.

5. The paper-out mechanism of claim 4, wherein a flange is formed on the motor, a plurality of mounting holes is defined in the flange, a plurality of fixing holes is defined on a paper out wall, the flange is mounted on the paper out wall via a plurality of screws.

6. The paper-out mechanism of claim 1, wherein a titled load portion extends from the adapter portion, the load portion is capable of receiving printed paper thereon.

7. A paper-out mechanism for a printing apparatus, the mechanism comprising:

a paper out wall defining a paper out opening; and a paper out board movably mounted adjacent to the paper out opening, a width of the paper out board being greater than that of the paper out opening, the paper out board being capable of being located in different positions with respect to the paper out opening to stagger received printed paper on the paper out board;

wherein two restricting pieces are located on the paper out board, a sleeve is located and secured between the two restricting pieces, the sleeve defines a screw hole; a threaded rod is mounted on the paper out wall, the threaded rod is adapted to screw in the screw hole of the sleeve to drive the sleeve and the paper out board sliding.

8. The paper-out mechanism of claim 7, wherein each of the two restricting pieces defines a through hole; a pair of securing seats is located on opposites edges of the paper out opening, each securing seat defines a securing hole therein; a guiding pole extends through the through hole of the paper out board, and opposite ends of the guiding pole are mounted in the securing holes to slidably mount the paper out board adjacent to the paper out opening.

9. The paper-out mechanism of claim 7, wherein each of the two restricting pieces defines a receiving hole, the screw hole of the sleeve is in alignment with the receiving holes of the two restricting pieces, the threaded rod extends through the receiving holes.

10. The paper-out mechanism of claim 7, wherein the threaded rod is mounted on a motor, the motor is capable of rotating the threaded rod in the screw hole of the sleeve.

11. The paper-out mechanism of claim 10, wherein a flange is formed on the motor, a plurality of mounting holes is defined in the flange, a plurality of fixing holes is defined on the paper out wall, the flange is mounted on the paper out wall via a plurality of screws.

12. The paper-out mechanism of claim 7, wherein the paper out opening comprises a first edge and a second edge; the paper out board comprises an adapter portion, the adapter portion comprises a first side and a second side; a distance between the first side and second side of the adapter portion is greater than a distance between the first edge and the second edge of the paper out opening; the paper out board is capable of sliding to have the first side in alignment with the first edge or have the second side in alignment with the second edge to locate the paper out board on different positions with respect to the paper out opening.

13. The paper-out mechanism of claim 12, wherein a titled load portion extends from the adapter portion, the load portion is capable of receiving printed paper thereon.

14. A paper-out mechanism for a printing apparatus, the mechanism comprising:

a paper out wall defining a paper out opening; and a paper out board movably mounted adjacent to the paper out opening, a width of the paper out board being greater than that of the paper out opening, the paper out board is capable of being located in different positions with respect to the paper out opening to stagger received printed paper on the paper out board;

wherein a sleeve is mounted on one of the paper out board and the paper out wall, a rod is rotatably mounted on the other one of the paper out board and the paper out wall, the rod is inserted in the sleeve, and the rod is adapted to rotate in the sleeve to drive the paper out board and the sleeve sliding relative to the paper out wall; and the sleeve defines a screw hole, and the rod is screwed in the screw hole, two restricting pieces are located on the paper out board, and the sleeve is located and secured between the two restricting pieces.

15. The paper-out mechanism of claim 14, wherein the paper out opening comprises a first edge and a second edge; the paper out board comprises an adapter portion, the adapter portion comprises a first side and a second side; a distance between the first side and second side of the adapter portion is greater than a distance between the first edge and the second edge of the paper out opening; the paper out board is capable of sliding to have the first side in alignment with the first edge and have the second side in alignment with the second edge to locate the paper out board on different positions with respect to the paper out opening.

* * * * *